US009925411B2

(12) United States Patent
Huang et al.

(10) Patent No.: US 9,925,411 B2
(45) Date of Patent: Mar. 27, 2018

(54) EXERCISE MACHINE HAVING A HUBLESS ROTARY MECHANISM

(71) Applicant: Dyaco International Inc., Taipei (TW)

(72) Inventors: Hsuan Fu Huang, Taipei (TW); Tung Hsing Chang, Taipei (TW); Han Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 50 days.

(21) Appl. No.: 14/934,216

(22) Filed: Nov. 6, 2015

(65) Prior Publication Data

US 2017/0128771 A1 May 11, 2017

(51) Int. Cl.
*A63B 22/04* (2006.01)
*A63B 22/06* (2006.01)

(52) U.S. Cl.
CPC ..... *A63B 22/04* (2013.01); *A63B 22/0664* (2013.01); *A63B 2022/0676* (2013.01)

(58) Field of Classification Search
CPC ..... A63B 22/0048–22/0069; A63B 22/0664; A63B 2022/0043; A63B 2022/0048; A63B 2022/0051; A63B 2022/0053; A63B 2022/067; A63B 2022/0676; A63B 2022/0682; A63B 2022/0688; A63B 23/0417–23/0429; A63B 2023/0441–2023/0452; A63B 21/00192; A63B 21/005; A63B 21/0056; A63B 21/012; A63B 21/0125; A63B 21/015
USPC ..... 482/51–53, 57–65
See application file for complete search history.

(56) References Cited

U.S. PATENT DOCUMENTS 3,329,444 A * 7/1967 Lidov ..... B60B 1/003 156/112
4,423,863 A 1/1984 Figueroa
4,463,945 A * 8/1984 Spector ..... A63B 22/0012 482/112
4,561,648 A * 12/1985 Wu ..... A63B 22/0087 482/65
4,768,777 A 9/1988 Yang
4,961,571 A 10/1990 Lin
5,312,312 A * 5/1994 Fernandez ..... A63B 22/0007 482/60
6,224,080 B1 * 5/2001 Ross ..... B60B 3/048 280/260
6,482,130 B1 11/2002 Pasero et al.
(Continued)

OTHER PUBLICATIONS

Hung, H., "The most fashionable Indoor bike," Nov. 27, 2012, two pages, retrieved from http://play.aili.com/1633/564388.html.
(Continued)

*Primary Examiner* — Gregory Winter
(74) *Attorney, Agent, or Firm* — Finnegan, Henderson, Farabow, Garrett & Dunner LLP

(57) ABSTRACT

An exercise machine includes a frame, a first rotary mechanism supported on the frame, a second rotary mechanism rotatably engaging with the first rotary mechanism, and a driving mechanism operatively coupled to the second rotary mechanism and configured to impart rotation of the second rotary mechanism while the driving mechanism is being actuated. The second rotary mechanism is hubless. The second rotary mechanism is configured to absorb and retain an amount of the actuation of the driving mechanism as a moment of inertia while the second rotary mechanism rotates.

13 Claims, 7 Drawing Sheets

(56) References Cited

U.S. PATENT DOCUMENTS

| | | | | |
|---|---|---|---|---|
| 7,547,267 | B1 | 6/2009 | Wang | |
| 7,794,365 | B2 | 9/2010 | Daniel | |
| 8,430,797 | B2 * | 4/2013 | Wan | A63B 69/16 482/61 |
| 8,640,569 | B2 | 2/2014 | Chen et al. | |
| 2003/0228961 | A1 * | 12/2003 | Huang | B62K 1/00 482/110 |
| 2009/0156371 | A1 * | 6/2009 | Goldberg | A63B 21/225 482/62 |
| 2009/0239714 | A1 | 9/2009 | Sellers | |
| 2010/0069205 | A1 * | 3/2010 | Lee | A63B 21/0051 482/63 |
| 2011/0152040 | A1 * | 6/2011 | van der Meer | A63B 21/00196 482/57 |
| 2014/0371035 | A1 | 12/2014 | Mortensen et al. | |
| 2015/0080195 | A1 | 3/2015 | Yeh | |

OTHER PUBLICATIONS

Unwire.hk, "Hollow Bike with no hub and spokes," Sep. 13, 2013, seven pages, retrieved from http://unwire.hk/2013/09/13/sada-bike/news/.

FatManandPop, "Future Cars 2020," May 17, 2010 uploaded, retrieved from www.youtube.com/watch?v=evbBMDkKJLE.

Nyaga, M., "future bikes," Jun. 23, 2009 uploaded, retrieved from www.youtube.com/watch?v=8x--geLsJll.

Kimerykreations, "Wheels of Tomorrow One Wheeler (Monocycle)," May 19, 2010 uploaded, retrieved from www.youtube.com/watch?v=fVKeJ1vGNfo.

* cited by examiner

EXERCISE MACHINE HAVING A HUBLESS ROTARY MECHANISM

TECHNOLOGY FIELD

The present disclosure relates to an exercise machine having a hubless rotary mechanism.

BACKGROUND

A conventional exercise machine often includes a rotary mechanism to facilitate the workout of a user operating the exercise machine. For example, the rotary mechanism is used to enable a continuous motion of the user. A conversion unit that attempts to provide the user with a smooth ride by absorbing and retaining energy or by changing an output of the user's exercising effort is often provided with the rotary mechanism. The conversion unit, however, adds design complications to the exercise machine and increases the cost of manufacturing and maintaining the exercise machine. An example of the conversion unit is a gear or pulley system, such as a step-up system, that couples with the rotary mechanism. The gear or pulley system having a multitude of hardware can be subjected to frequent wear and prone to mechanical failure due to design faults or lack of maintenance.

A solution is needed to minimize or eliminate the problems created by the conversion unit while still being able to provide an exercise machine that is easier to design and cheaper to produce and maintain, while being capable of providing a smooth ride to the user.

SUMMARY

Consistent with embodiments of the present disclosure, there is provided an exercise machine having a hubless rotary mechanism. According to an aspect of the disclosure, an exercise machine includes a frame, a first rotary mechanism supported on the frame, a second rotary mechanism rotatably engaging with the first rotary mechanism, and a driving mechanism operatively coupled to the second rotary mechanism, the driving mechanism being capable of imparting rotation of the second rotary mechanism while the driving mechanism is being actuated. The second rotary mechanism may be hubless and may be configured to absorb and retain an amount of the actuation of the driving mechanism as a moment of inertia while the second rotary mechanism rotates.

According to another aspect of the disclosure, an exercise machine includes a frame, a plurality of freely rotatable rollers supported on the frame, a hubless flywheel having a circumferential surface engaging with at least one of the plurality of rollers such that a rotation of the hubless flywheel causes the at least one of the plurality of freely rotatable rollers to rotate, and a linkage system operatively coupled to the hubless flywheel and including a link configured to receive a user input, the linkage system configured to transmit the user input to the hubless flywheel. The hubless flywheel is configured to retain inertia when the hubless flywheel is being rotated.

According to yet another aspect of the disclosure, an exercise machine includes a frame including a base having a first end and a second end, a first frame member, a second frame member, and a third frame member. The third frame member is configured to extend from the first frame member. The base joins the first frame member and the second frame member to form a first space at the first end of the base. The exercise machine also includes a plurality of rollers provided on the frame within the first space, and a hubless flywheel provided within the first space and rotatably engaged with the plurality of freely rotatable rollers. The hubless flywheel is configured to retain rotational inertia. The exercise machine further includes a driving mechanism having a first pair of links operatively coupled to the hubless flywheel and the second end of the base, a second pair of links operatively coupled to the first pair of links, and a third pair of links operatively coupled to the second pair of links and the third frame member. The second pair of links includes a pair of user input devices configured to move in an elliptical path.

Embodiments of the present disclosure provide an exercise machine having a hubless rotary mechanism that can be weighted to absorb and retain an amount of a user input as inertia to provide a smooth ride to the user. Embodiments of the present disclosure provide an exercise machine having a simpler configuration that is easier to design and cheaper to produce and maintain.

Features and advantages consistent with the disclosure will be set forth in part in the description which follows, and in part will be obvious from the description, or may be learned by practice of the disclosure. Such features and advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments and together with the description, serve to explain the principles of the invention.

DESCRIPTION OF THE EMBODIMENTS

Figure 1:
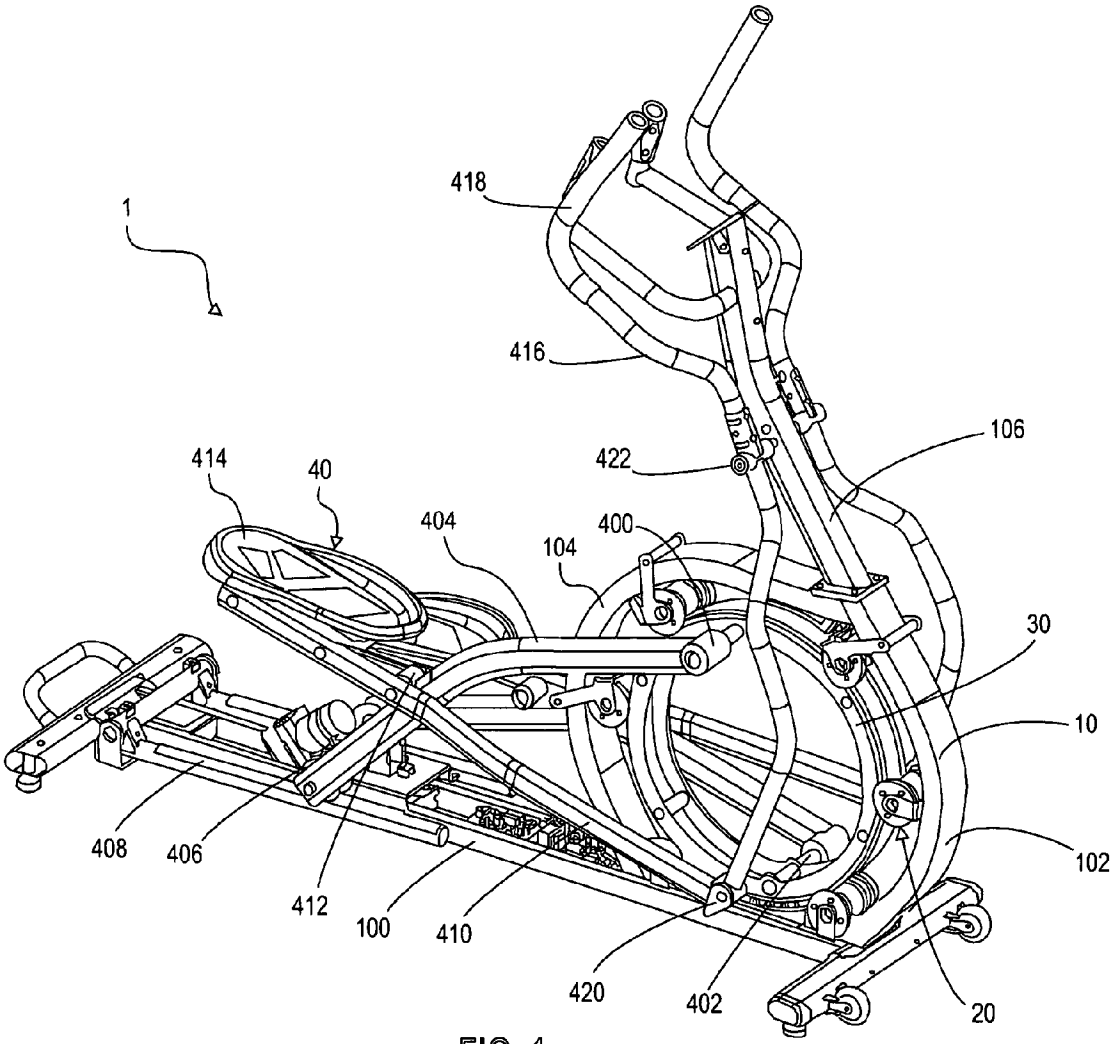
FIG. 1 is a perspective view showing an exercise machine according to an embodiment of the disclosure.

Embodiments consistent with the disclosure include an exercise machine having a first rotary mechanism, a second rotary mechanism, a driving mechanism, and a frame. The second rotary mechanism is capable of rotatably engaging with the first rotary mechanism in a hubless manner to provide inertia converted from user input acted through the driving mechanism. As used herein, "rotatable engagement" or related terms refers to an engagement between two objects moving, pivoting, or rotating relatively.

Hereinafter, embodiments consistent with the disclosure will be described with reference to drawings. Wherever possible, the same reference numbers will be used throughout the drawings to refer to the same or like parts.

According to some embodiments of the disclosure, an exercise machine includes a frame, a first rotary mechanism, a second rotary mechanism, and a driving mechanism. The first rotary mechanism is operatively coupled to the second rotary mechanism, which is connected to and driven by the driving mechanism. The first rotary mechanism, the second rotary mechanism, and the driving mechanism can be operatively coupled to the frame. The first rotary mechanism, the second rotary mechanism, and the driving mechanism can be supported on the frame. For example, the first rotary mechanism can be directly supported on the frame, and the second rotary mechanism can be indirectly supported on the frame via the first rotary mechanism, which directly holds the second rotary mechanism in position. In some embodiments the second rotary mechanism may be a disc-shaped or ring-shaped object having a circumferential surface and a radial surface. The first rotary mechanism in those embodiments can be configured to hold the second rotary mechanism in position by contacting the circumferential surface, radial surface, or both, of the second rotary mechanism. In some embodiments, there can be multiple points of contact between the first rotary mechanism and the second rotary mechanism.

In some embodiments, the frame can support the first rotary mechanism, the second rotary mechanism, and the driving mechanism via additional components that may be required for a certain configuration of the exercise machine. In one embodiment, a part of the exercise machine, such as the frame or a part of the frame, may be attached to an environmental object, such as a wall, to facilitate support of the second rotary mechanism. The frame can include tubular members that are welded, screwed, bolted, glued, or otherwise connected together. Alternatively, the frame can be integrally formed in part or in whole. In some embodiments, the frame can be configured to include members that surround the first and second rotary mechanisms. For example, a part of the frame can be configured to encircle the second rotary mechanism at locations substantially in the same plane as the rotation of the second rotary mechanism and at distances away from a center of rotation of the second rotary mechanism. As an example, the frame can be configured to be positioned completely around the first and second rotary mechanisms at locations substantially in the same plane as the rotation of one of the first rotary mechanism and second rotary mechanism. The frame can be made of an alloy or metallic material, such as steel or aluminum, or a composite material, or a combination thereof.

The first rotary mechanism can include a plurality of rollers. The plurality of rollers can be attached to the frame and may be freely rotatable. The rollers can be fixedly positioned relative to the frame. Alternatively, or additionally, at least one of the rollers can be configured to be adjustable relative to the frame or the second rotary mechanism such that engagement of the at least one roller with the second rotary mechanism can be adjusted by moving the at least one roller towards or away from the second rotary mechanism. In some embodiments, the relative positions of at least two of the rollers can be adjusted. For example, at least one of the plurality of rollers can be detached, removed, or otherwise made to deviate from an engagement position with the second rotary mechanism to allow for installation, adjustment, or maintenance of the second rotary mechanism and/or at least one of the plurality of rollers. The rollers can be made of a metallic, plastic, or composite material, or a combination thereof.

The second rotary mechanism can include a flywheel. The flywheel can be engaged with and supported by the first rotary mechanism. For example, the flywheel can be engaged with a plurality of rollers and supported on at least a portion of the plurality of rollers. The flywheel can be configured to rotatably engage with two, three, four, or more rollers, and the weight of the flywheel can be supported on two, three, four, or more rollers. Thus, the weight of the flywheel can be transmitted through two, three, four, or more rollers when the flywheel is either static or rotating. Preferably, two of the plurality of rollers are configured to support the weight of the flywheel. Preferably, at least three rollers can be provided to rotatably engage with the flywheel.

The first rotary mechanism can be configured to be subjected to a load of the second rotary mechanism when the second rotary mechanism is rotating. For example, the first rotary mechanism may include a plurality of rollers that can be configured to withstand a load distribution exerted under a rotating second rotary mechanism, such as a flywheel, such that one or more of the rollers are capable of reacting to the load from the flywheel. Depending on at least the position of a roller, a roller may be strengthened to be able to withstand a higher stress than rollers at other positions. In addition, depending on at least the position of a roller, a roller may be strengthened to be able to withstand an uneven stress distribution within the roller because a part of the roller may experience more stress than other parts of the same roller. Preferably, rollers configured to support the weight of the flywheel can be made of a stronger material or strengthened by a reinforcing component, such as reinforcing plates, which may sandwich the rollers. In some examples, at least one of the plurality of rollers could experience less load compared with other rollers. For example, at least one of the plurality of rollers could experience little or negligible load of the flywheel. In some examples, at least one of the plurality of rollers can function as a lead-in roller or a lead-out roller that guides the rotation of the flywheel. In an exemplary configuration, such a lead-in roller or a lead-out roller may bear little or no weight of the flywheel when the flywheel is rotating at a certain speed, and the lead-in or lead-out roller can be configured with less strength than that of rollers that might bear more load, thereby saving cost, for example. It is to be noted that the strength of a roller included in the first rotary mechanism can be configured based on one or more of the position of the roller, the function of the roller, and the load from a static or rotating first rotary mechanism.

In some embodiments, the first rotary mechanism or the second rotary mechanism, or both, are operatively coupled to a cushion mechanism. For example, a cushion mechanism can be operatively coupled to the first rotary mechanism to facilitate a desired rotation of a flywheel by, for example, absorbing vibration caused by the rotation of either or both of the first and second rotary mechanisms. In some embodiments in which the first rotary mechanism includes a plurality of rollers, a cushion mechanism can be operatively coupled between the frame and at least one of the plurality of rollers. Alternatively, a roller itself can be configured as a cushion mechanism by including an elastic material, for example. In some embodiments, a cushion mechanism can be integrated with the first rotary mechanism or the second rotary mechanism, or both. In further embodiments, a number of cushion or shock-absorbing units can be provided to couple both the first and second rotary mechanisms. A cushion mechanism can include, for example, a spring, a damping roller, or other types of a shock-absorbing mechanisms, or a combination thereof.

The first and second rotary mechanisms can be configured to engage in a frictional contact between the two rotary mechanisms to allow relative motion of the first and second rotary mechanisms. For example, the second rotary mechanism, such as a flywheel, can be configured to rotatably engage with the first rotary mechanism, such as a plurality of rollers, by providing a frictional contact between the flywheel and the plurality of rollers. The frictional contact between the flywheel and the plurality of rollers can be sufficiently provided such that the rotation of the flywheel causes the rotation of the rollers contacting the flywheel. In some embodiments, a total frictional contact between the first and second rotary mechanisms may be allowed to be reduced during rotation of the second rotary mechanism. In some embodiments in which the first and second rotary mechanism have multiple contact points between them, a rolling contact or a contact at all times may not be required at particular speeds for at least one of the multiple contact points between the first and second rotary mechanisms. For example, slippage or non-contact of at least one of the plurality of rollers may be allowed to occur between the flywheel and at least one of the plurality of rollers such that the rotation of the flywheel can still be sustained lacking a full contact of the slipping or non-contacting roller. For example, at least one out of six rollers provided on the exercise machine may be allowed to slip or disengage from the flywheel such that the flywheel is able to rotate or continue to rotate at a certain speed.

According to some embodiments of the disclosure, the second rotary mechanism can include a hubless flywheel. For example, a flywheel can be a hubless ring having an inner diameter, outer diameter, a radial length between the inner diameter and the outer diameter, and a thickness perpendicular to the direction of a circumference of the flywheel. That is, a thickness of the hubless flywheel extends in a direction similar to the direction that a thickness of a conventional axled flywheel would extend in the direction of an axle. For example, the hubless flywheel may approach the shape of a ring. In some embodiments, a radial length between the inner diameter and the outer diameter of a hubless flywheel can be configured to extend sufficiently to result in a size or weight of the flywheel depending on the type and configuration of the exercise machine.

The second rotary mechanism, such as a hubless flywheel, can be engaged with the first rotary mechanism, such as a plurality of rollers, such that the engagement enables rotation of the hubless flywheel. For example, rotation of a hubless flywheel in the exercise machine can be enabled solely by an engagement of the hubless flywheel with the first rotary mechanism. In some embodiments, the second rotary mechanism provided in the exercise machine can be configured to operate in conjunction with the first rotary mechanism without an axle, a hub-and-spoke arrangement, or a physical center of rotation of the second rotary mechanism. In some embodiments, an engagement between the first and second rotary mechanism can be configured to allow a relative displacement between the two mechanisms. For example, the engagement can be configured such that a center of rotation of the hubless flywheel during rotation may not coincide with a geometric center of the flywheel when the flywheel is not rotating. The displacement so occurred can be accomplished by providing a cushion mechanism to the exercise machine, as described above. In some embodiments, however, the shift of the center of rotation of the hubless flywheel from the static or geometric center of the flywheel may be less desirable and a displacement of the hubless flywheel relative to the first rotary mechanism, or a portion of the first rotary mechanism, is to be minimized.

In some embodiments, the first rotary mechanism can be configured to apply a pressure against the first rotary mechanism. For example, the first rotary mechanism can include a plurality of rollers and at least one of the rollers is configured to assert a pressure on the first rotary mechanism. The pressure asserted by the at least one of the rollers can be adjusted by an adjuster, for example, to facilitate a desired contact between the first and second rotary mechanism. In some embodiments, a roller of the first rotary mechanism can be adjusted along a direction such that an acute angle forms between the direction of adjustment and a radius of the second rotary mechanism that passes through the point of contact of the roller with the second rotary mechanism.

In some embodiments in which the first rotary mechanism includes a plurality of rollers and the second rotary mechanism includes a hubless flywheel, the hubless flywheel can be configured to include a circumferential surface having a recess to engage with at least one of the rollers. In some embodiments, the at least one of the rollers can be configured to include a circumferential surface having a protrusion, which can extend into and thus engage with a recess in the circumferential surface of the hubless flywheel. In some embodiments, the hubless flywheel can be configured to include a protrusion on the circumferential surface of the flywheel and at least one of the plurality of rollers can be configured to include a recess in the circumferential surface of the at least one roller so that the protrusion of the flywheel can extend into and thus engage with the recess of the at least one roller. In some embodiments, the hubless flywheel can be configured to include a recess and a protrusion for engagement with a protrusion and a recess, respectively, of the at least one of the plurality of rollers.

The driving mechanism can be connected to the second rotary mechanism. For example, the driving mechanism can be operatively coupled to the second rotary mechanism and can be configured to drive the motion of the second rotary mechanism. In some embodiments in which the second rotary mechanism is a hubless flywheel, the driving mechanism can be attached to the flywheel at one side or both sides of the flywheel. Each side of the second rotary mechanism can be attached to the driving mechanism and the two points of attachments can be spaced 180 degrees apart. In some embodiments, a point of such attachment can be provided at a radial surface of the flywheel. Alternatively, or additionally, the driving mechanism can be attached to a connecting piece, such as a bracket, which in turn can be attached to the flywheel. In some examples, the driving mechanism can include a link coupled to the flywheel to form a rotary joint or a pivot, which allows relative motion between the link of the driving mechanism and the flywheel. For example, the driving mechanism, or a part of or a link thereof, can be attached to the second rotary mechanism, such as a hubless flywheel, and can be configured to rotate, pivot, or otherwise move relative to the hubless flywheel while the flywheel rotates. In some embodiments, the driving mechanism can include or is attached to links or components that move in synchrony with the rotation of second rotary mechanism. The driving mechanism can move along a path while the flywheel rotates. A link of the driving mechanism can move along a path, such as a closed path or reciprocal path. A path of movement of a link of the driving mechanism can include a circular path, an elliptical path, a reciprocal path, a linear path, a non-linear path, a similar path to any of the above, or a combination thereof. In some examples, the driving mechanism, or one or more links thereof, such as a pair of pedals, handles or pads, can move along a closed path at the same rate of revolution as the second rotary mechanism rotates. In some embodiments, the driving mechanism can include links or components that rotate at the same angular velocity as the second rotary mechanism does. A pedal, handle, or pad for receiving user input can be positioned at each side of the second rotary mechanism, such as at a radial surface of each side of a hubless flywheel.

In some embodiments, the driving mechanism can include a plurality of links or a linkage system capable of providing predetermined and/or adjustable kinematics of the links. The links and their connections may be designed to permit a specific workout of the user of the exercise machine. For example, the driving mechanism can include links that allow a user of the exercise machine to operate or actuate the links to move a part of the user's body in a motion including, but not limited to, an elliptical or near elliptical motion, a circular or near circular motion, a linear or near linear motion, an arcuate or near arcuate motion, or a combination thereof. The driving mechanism may be designed such that the user motion can be continuous or reciprocal. In some embodiments, the driving mechanism may be designed to allow the user to drive the second rotary mechanism in either a clockwise direction or a counterclockwise direction of rotation.

In some embodiments, the driving mechanism can be configured to transmit input from a user to the second rotary mechanism. For example, the driving mechanism can be configured to directly transmit input from a user of the exercise machine to the second rotary mechanism. A user can impart rotation of the second rotary mechanism through the driving mechanism by acting directly on the driving mechanism. In some examples, the driving mechanism can include pads, pedals, or handles allowing actuation by the user. Alternatively, a user can operate on one or more links, such as links that are attached to the driving mechanism, to impart rotation of the second rotary mechanism. In some embodiments, the driving mechanism transmits user input, in the form of, for example, pressure, power, force, weight, or energy, from a user to impart rotation of the second rotary mechanism and/or the first rotary mechanism.

The second rotary mechanism can be configured to absorb energy while the driving mechanism being actuated by a user drives the second rotary mechanism. The second rotary mechanism can be configured to absorb user input, which can directly provide for a moment of inertia of the second rotary mechanism. In some embodiments in which the second rotary mechanism includes a hubless flywheel, user input can be absorbed by the hubless flywheel while the driving mechanism is being actuated by a user, and at least an amount of the absorbed user input can directly provide for a moment of inertia of the hubless flywheel. In some embodiments, the hubless flywheel can be weighted to be capable of generating rotational inertia of the flywheel while the flywheel is rotating. For example, a moment of inertia of the second rotary mechanism can be configured to be generated only at a peripheral portion of the second rotary mechanism. In some embodiments, the second rotary mechanism, such as a hubless flywheel, can be configured to convert into rotational kinetic energy from a substantial amount of user input by actuating the driving mechanism of the exercise machine. Alternatively, a substantial amount of the user input can be converted into rotational kinetic energy of both the first and second rotary mechanisms. In some examples, a substantial amount of the user's input to the driving mechanism can be transmitted from the driving mechanism to the hubless flywheel and converted into rotational kinetic energy defined in terms of moment of inertia and angular speed of the flywheel.

In some embodiments, the second rotary mechanism can be configured to provide a moment of inertia to create a feel of a smooth and continuous ride to the user of the exercise machine. In these embodiments, a weighted hubless flywheel can be implemented as the second rotary mechanism. The hubless flywheel can be configured to provide an inertial rotation at a given speed. In some embodiments, the second rotary mechanism, such as a hubless flywheel, can be weighted and constitute as the sole energy-absorbing mechanism that converts user input to provide rotational inertia in the exercise machine. Alternatively, a combination of the first and second rotary mechanisms can provide increased rotational inertia converted from user input and constitute as the sole inertial device in the exercise machine. The exercise machine can take advantages of using only the second rotary mechanism or only a combination of the first and second rotary mechanisms to generate rotational inertia to avoid or decrease the chances of mechanical failure commonly occurred for conventional gearing systems that produce or facilitate rotational inertia. A gear chain or pulley system that otherwise is required to produce inertia may not be required according to some embodiments of the present disclosure.

In some embodiments, the first rotary mechanism can be weighted to provide rotational inertia through rotational engagement with the second rotary mechanism. For example, at least some of the user input can be absorbed by and stored in the first rotary mechanism in the form of a moment of inertia while there is a non-slip condition between the first and second rotary mechanisms when the first rotary mechanism rotates in concert with the second rotary mechanism. In some embodiments in which a plurality of rollers is implemented as the first rotary mechanism, at least one of the plurality of rollers can be weighted to be able to absorb, through engagement with the second rotary mechanism, an amount of user actuation on the driving mechanism and provide for rotational inertia. Thus, a higher moment of inertia can be experienced by the user by increasing the moment of inertia of the first rotary mechanism without the need to increase the weight of the second rotary mechanism. Another advantage of providing increased inertia in the first rotary mechanism may be that it could feel easier to a user to start out the workout actuating the driving mechanism.

The second rotary mechanism and/or the first rotary mechanism can be constructed with a predetermined weight. Alternatively, or additionally, one or more weight blocks 304 can be removably attached to either or both of the first and second rotary mechanisms. In embodiments in which the second rotary mechanism includes a hubless flywheel having an inner ring and an outer ring, one or more weights can be attached between the inner and outer rings. In some examples, one or more weights can be provided close to an outer circumference of the outer ring of the hubless flywheel. In some embodiments, the first rotary mechanism can include a plurality of rollers and at least one of the rollers can be configured to have a weight that is capable of contributing to the overall rotational inertia that the user will experience. A weight or weight block 304 may be provided in the form of a cuboid, a disc, or a ring, or any other suitable shape for fitting on the first rotary mechanism and/or second rotary mechanism.

In some embodiments, the second rotary mechanism and/or the first rotary mechanism are configured to produce rotational inertia that can be adjusted. For example, one or more weights can be added to or removed from the first and/or second rotary mechanisms. In some embodiments, one or more weights can be selectively provided in the first and/or second rotary mechanisms. The position and the number of weights can be adjusted in the first and/or second rotary mechanisms to achieve desired rotational inertia. In some embodiments, a weight can be provided in a position at or close to the circumference of the first and/or second rotary mechanisms.

In some embodiments, a stopper can be provided close to a radial surface of the hubless flywheel such that potential sideways movements of the flywheel may be limited by the stopper. The stopper can include a rotatory device such as a roller or a ball, or a similar device capable of limiting sideways movements of the flywheel. In some embodiments, the function of limiting sideways movements of the second rotary mechanism can be implemented in the first rotary mechanism. For example, the first rotary mechanism can include at least one roller having a circumferential surface and a recess extending in the circumferential surface. The second rotary mechanism can be configured to engage with the first rotary mechanism such that sideways movements of the second rotary mechanism can be limited by side walls of the recess of the roller.

According to some embodiments of the present disclosure, a resistance device can be provided in the exercise machine to create a force opposing the rotation of the second rotary mechanism and/or the first rotary mechanism. A resistance device can be of a mechanical, electrical, or magnetic type, or a combination thereof. In some examples, a magnetic resistance device can include a magnetic device and a conductive device. The conductive device can be attached to, for example, the second rotary mechanism, and the magnetic device can be provided close to the conductive device such that when the conductive device moves relative to the magnetic device, an electromagnetic force will be generated opposing the movement of the conductive device and the second rotary mechanism. In some embodiments, a magnetic device can be provided underneath the second rotary mechanism, and a conductive device can be provided on a circumferential surface of the second rotary mechanism such that a force may be generated between the magnetic device and the conductive device to oppose the rotation of the second rotary mechanism. For example, when the second rotary mechanism includes a hubless flywheel, a conductive strip can be provided on a circumferential surface of the flywheel and can be configured to interact with a magnet or an electromagnet when the conductive strip rotates with the flywheel. In some embodiments in which the second rotary mechanism includes a hubless flywheel having a circumferential surface and a recess in the circumferential surface, a conductive device can be provided in the recess. In some embodiments, a conductive device can be provided on a radial surface of the hubless flywheel and can be configured with a magnetic device positioned nearby. For example, segments of a conductive material can be provided on radial surfaces of the hubless flywheel. Alternatively, a ring of conductive strip can be provided on the radial or side surface of the hubless flywheel. In some embodiments, a conductive device is provided on the second rotary mechanism such that contact between the conductive device and the first rotary mechanism may be minimized or eliminated. For example, the first rotary mechanism can include a plurality of rollers in which a roller capable of engaging with the second rotary mechanism can be configured with a recess on its circumferential surface to avoid contact with a conductive device provided on the second rotary mechanism. In some embodiments, an alternative or second resistance device can be operatively coupled to the driving mechanism to generate a resistance opposing a movement of the driving mechanism. For example, a magnetic device and a conductive device can be provided to oppose relative motions between two links of the driving mechanism, or between a link of the driving mechanism and the frame of the exercise machine.

In some embodiments, the second rotary mechanism can include a hubless flywheel having an inner ring and an outer ring. The inner ring can be configured to have a maximum diameter less than an inner diameter of the outer ring. The inner and outer rings can be provided in a concentric manner. The inner ring can be nested inside the outer ring. For example, an outer circumferential surface of the inner ring can be configured to face an inner circumferential surface of the outer ring. The outer ring can be configured to engage with the first rotary mechanism. In some examples, a rotatable joint between the driving mechanism and the hubless flywheel can be formed between the inner ring and the outer ring. Alternatively, the driving mechanism can be operatively coupled to either the outer ring or the inner ring.

In some embodiments, the second rotary mechanism can include first and second hubless flywheels provided side-by-side or with a distance between the first and second flywheels. Each of the first and second flywheels can be configured to engage with a separate first rotary mechanism. The first and second hubless flywheels can be operatively coupled to the same driving mechanism and both of the first and second flywheels can be configured to rotate in concert. Alternatively, each of the first and second hubless flywheels can be operatively coupled to an individual driving mechanism, such as a driving mechanism described in the present disclosure. This arrangement allows for selective use of the first and second flywheels by the user. For example, the first and second flywheels can be capable of rotating out of synchronization, such as when the first flywheel rotates at an angular velocity different from that of the second flywheel. The first and second flywheels can also be configured to rotate in different directions at the same time. In addition, one of the first and second flywheels can be configured to completely stop while the other of the first and second flywheels is rotating. In some embodiments, the arrangement can be configured to include two different types of motions, each of which is enabled by a corresponding driving mechanism.

In some embodiments, a combination of the first and second rotary mechanisms can be configured to be fitted to the frame of the exercise machine as a unit providing rotational inertia. For example, a combination of the first and second rotary mechanisms can be configured to have a bearing structure. The second rotary mechanism can be a rotating ring, such as an inner ring, and the first rotary mechanism can include a plurality of rollers, such as a plurality of balls, and an outer ring that provides support to the plurality of balls. The plurality of balls can be encased between the inner ring and an outer ring attached to the frame. In this bearing configuration, the inner ring can be configured to rotatably engage with the plurality of rollers. The inner ring can be weighted to provide rotational inertia. By rotatably coupling the inner ring to the driving mechanism as described above, the inner ring can be driven by the driving mechanism to rotate.

Several embodiments of an elliptical exercise machine are described below having features that are consistent with the disclosure. It is understood that the invention should not be limited to a specific type of exercise machine, such as an elliptical exercise machine, but encompasses any exercise machine as defined by the appended claims. For example, the invention can include an exercise machine allowing at least a part of a human body to move along a circular path, a linear path, an arc, or the like, when the exercise machine is being operated.

Figure 2:
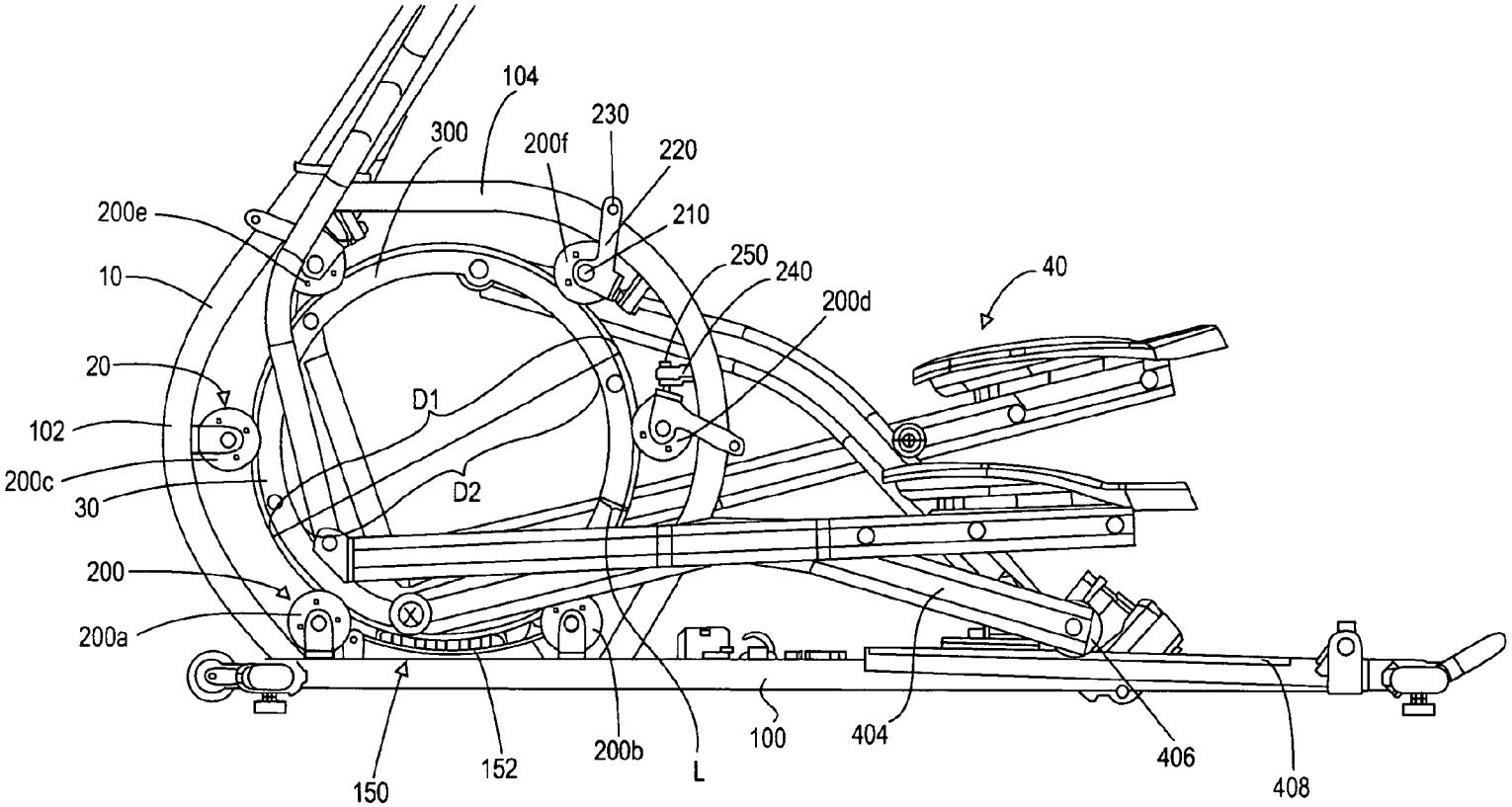
FIG. 2 is a partially enlarged side view showing the exercise machine depicted in FIG. 1.

FIG. 1 shows a perspective view of an exercise machine 1 according to an embodiment of the disclosure. FIG. 2 shows a partially enlarged side view of an exercise machine 1 according to an embodiment of the disclosure. As shown, exercise machine 1 includes a frame 10, a first rotary mechanism 20, a second rotary mechanism 30, and a driving mechanism 40. Frame 10 is configured to support first rotary mechanism 20, second rotary mechanism 30, and driving mechanism 40. Frame 10 includes a base 100 horizontally provided on or above a floor and joined to one end of a first frame member 102 and one end of a second frame member 104. First frame member 102 and second frame member 104 are positioned near an end, such as a front end, of exercise machine 1 such that first frame member 102 and second frame member 104 are generally in front of a user operating exercise machine 1. First frame member 102 and second frame member 104 are shaped to include curved portions and are connected to each other to enclose a space accommodating first rotary mechanism 20 and second rotary mechanism 30. In some embodiments, first frame member 102 and second frame member 104 may be replaced by a single member, or either or both of them may be integrally formed with frame 10. In some examples, frame 10 may or may not completely surround first rotary mechanism 20 and second rotary mechanism 30. First rotary mechanism 20 and/or second rotary mechanism 30, in part or in whole, can be exposed and not surrounded or covered by frame 10.

As shown in FIGS. 1 and 2, first rotary mechanism 20 includes six rollers 200, such as 200*a*, 200*b*, 200*c*, 200*d*, 200*e*, 200*f*, which are attached to frame 10 at respective positions. Rollers 200*a* and 200*b* are provided on base 100, and can sometimes be referred to as "base rollers." Rollers 200*a* and 200*b* are spaced apart by a distance less than a diameter of second rotary mechanism 30. In this embodiment, rollers 200*a* and 200*b* are configured to have sufficient strength, for example, to support most of the weight of second rotary mechanism 30. Rollers 200*c* and 200*d* are provided on first frame member 102 and second frame member 104, respectively. Roller 200*c* and/or roller 200*d* can function as a lead-in roller or a lead-out roller depending on which direction second rotary mechanism 30 rotates. For example, roller 200*c* and/or roller 200*d* can be configured or adjusted towards second rotary mechanism 30. Rollers 200*e* and 200*f* are also provided on first frame member 102 and second frame member 104, respectively, and are generally provided near the top of second rotary mechanism 30. Roller 200*e* and/or roller 200*f* can also function as a lead-in or lead-out roller. Each of rollers 200 is freely rotatable about an axle 210 held by a bracket 220, which is, for example, welded, screwed, or bolted to, or otherwise connected to frame 10. For each of rollers 200*d*, 200*e*, 200*f*, bracket 220 is attached to and pivotable about an axle 230 fixed to frame 10. An ear 240 is provided on frame 10 and coupled to an adjuster, such as a screw or a differential screw 250, an end, such as a tip, of which is positioned close to the bracket 220. Screw 250 can be threaded to ear 240 and screwed towards bracket 220. Screw 250 can be screwed to urge against bracket 220 such that roller 200 is urged against second rotary mechanism 30. The direction of screw 250 may be configured to pass through a center, such as axle 210, of a roller 200. Alternatively, the direction of screw 250 can be configured to offset from a center of a roller 200 such that an off-centered pressure is applied to the roller 200 through bracket 220. In some examples, the tip of screw 250 can be configured to contact a surface of bracket 220 at any angle.

Second rotary mechanism 30 includes a hubless flywheel 300, which is shown to be shaped as a ring without a hub, spoke, or a physical center of rotation. In this embodiment, hubless flywheel 300 includes a plurality of weighted rings attached together with screws. In certain instances, hubless flywheel 300 can include a single piece of weighted ring. Hubless flywheel 300 is configured to have an outer diameter D1, and inner diameter D2, and a radial length L between outer diameter D1 and inner diameter D2. Outer diameter D1, inner diameter D2, and radial length L define a radial surface at each side of hubless flywheel 300. Hubless flywheel 300 is configured to also include a thickness T, which is a perpendicular distance between radial surfaces of hubless flywheel 300 (see FIG. 6). In this embodiment, outer diameter D1, inner diameter D2, radial length L, and thickness T can be about 500 mm, about 480 mm, about 20 mm, and about 80 mm, respectively, and hubless flywheel 300 can be configured to include steel and weigh about 15 kg. However, other weights are possible. For example, hubless flywheel 300 can be configured to include, but is not restricted to, a weight ranging from about 6 kg to about 12 kg by configuring a size or dimension of hubless flywheel 300. In general, a weight of hubless flywheel 300 may depend on a specific type, model, and/or design of the exercise machine to generate, for example, different amounts of inertia.

Figure 6:
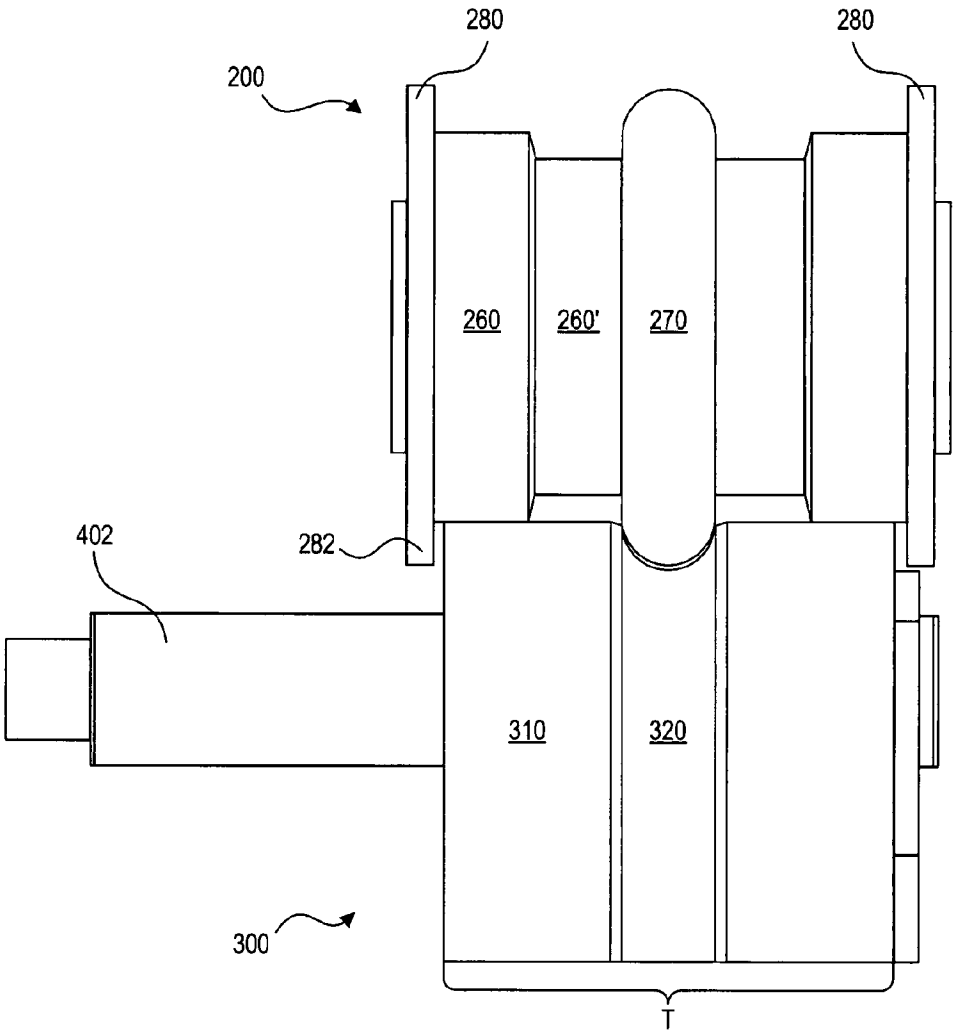
FIG. 6 is a partially enlarged view of an engagement between a roller and a hubless flywheel according to an embodiment of the disclosure.
Figure 7:
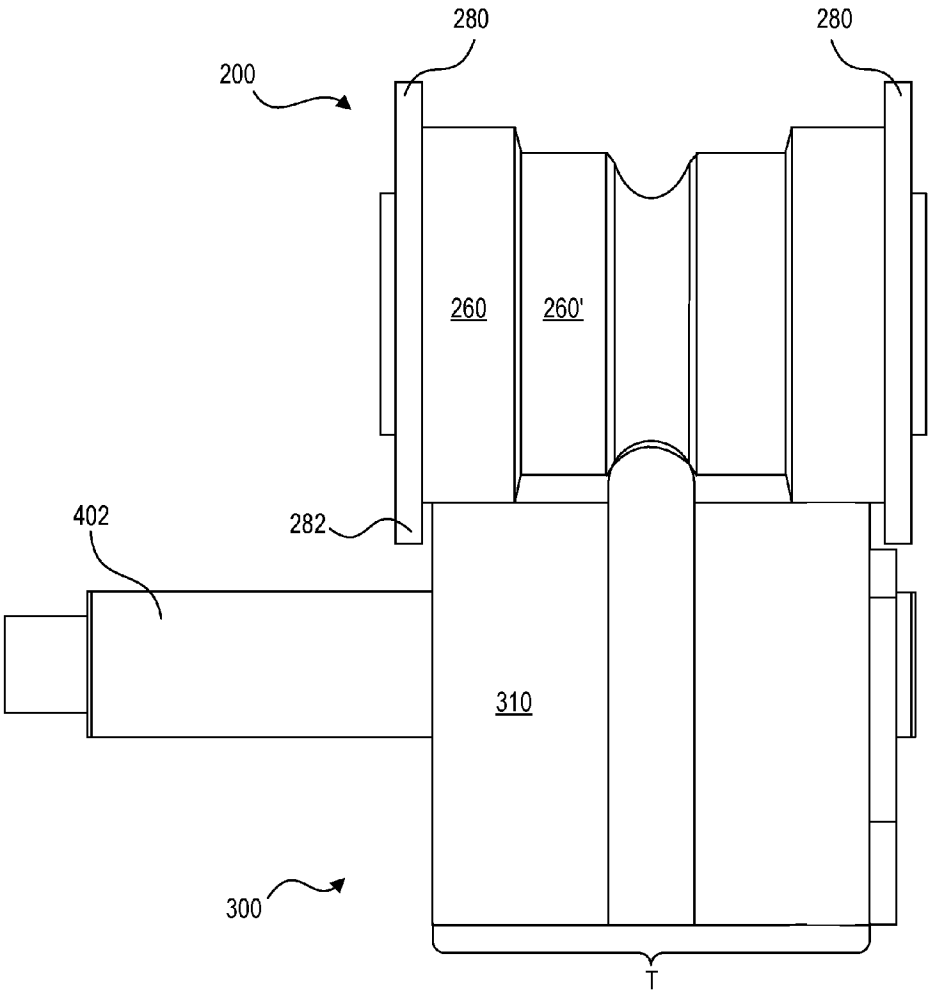
FIG. 7 is a partially enlarged view of another engagement between a roller and a hubless flywheel according to an embodiment of the disclosure.

Hubless flywheel 300 is configured to rotatably engage with rollers 200. Rotation of hubless flywheel 300 can impart rotation of one or more rollers 200. Rollers 200 are positioned around second rotary mechanism 30 such that they engage with hubless flywheel 300 at an outer circumferential surface of hubless flywheel 300. In other embodiments, rollers 200 may be positioned inside hubless flywheel 300 such that they engage with an inner circumferential surface of hubless flywheel 300. As shown in FIG. 6, which illustrates a partially enlarged view of an engagement between a roller 200 and a hubless flywheel 300 according to an embodiment of the disclosure, hubless flywheel 300 is configured to include a circumferential surface 310 engaging with a circumferential surface 260 of roller 200. For example, circumferential surface 310 can be configured to engage with circumferential surface 260 of rollers 200*a*, 200*b*, 200*c*, 200*d*, 200*e*, 200*f*. However, any one of rollers 200*c*, 200*d*, 200*e*, 200*f* can be configured to disengage from hubless flywheel 300 such as by moving, or "lifting," the roller away from hubless flywheel 300 by unscrewing screw 250. In certain instances, one or more of rollers 200*c*, 200*d*, 200*e*, 200*f* can be removed from exercise machine 1. For example, rollers 200*d* and 200*e* can be disengaged from hubless flywheel 300 or removed from exercise machine 1 while hubless flywheel 300 still rotatably engages with the rollers 200*a*, 200*b*, 200*c*, 200*f*. As described, rollers 200*d*, 200*e*, 200*f* are adjustable to provide a various degree of contact, or contacting pressure, with hubless flywheel 300. It is noted that rollers 200 provide the necessary engagement with hubless flywheel 300 and enable rotation of hubless flywheel 300. In addition, rollers 200*a* and 200*b* are spaced apart to provide a stable support to hubless flywheel 300 while allowing hubless flywheel 300 to rotate without being unobstructed by base 100, other parts of frame 10, or other components of exercise machine 1.

In this embodiment, driving mechanism 40 includes a number of links and joints that are capable of transmitting force and motion to hubless flywheel 300. A pair of joints 400 including respective axles 402 is rotatably coupled to side surfaces, such as radial surfaces, of hubless flywheel 300. Joints 400 are provided 180 degrees apart on a circumference of hubless flywheel 300. Each joint 400 connects to an axle 402, which is fixed to hubless flywheel 300 and extends perpendicularly from a radial surface of hubless flywheel 300, to one end of a side link 404. The other end of side link 404 is attached with a roller 406, which is configured to move reciprocally on a rail 408 set up on base 100 near a back end of exercise machine 1 while driving joint 400 to circle with the rotation of hubless flywheel 300. A swing link 410 is rotatably coupled to side link 404. As shown in FIG. 1, swing link 410 and side link 404 are coupled to form a joint 412 at or near a mid-section of each link. An end of swing link 410 nearer the back end of exercise machine 1 is attached with a foot pad 414 allowing actuating by a user. The other end of swing link 410 is movably coupled to an arm link 416 to form a joint 420. Arm link 416 is movably coupled at a joint 422 to a third frame member or post 106 extending from first frame member 102. As configured, movements of swing link 410 and arm link 416 transmit motion to side link 404 through joint 412. A handle 418 is attached to arm link 416 for optional grabbing by the user. Thus, pairs of side links 404, swing links 410, arm links 416, joints 400, joints 412, joints 420, joints 422, rollers 406, rails 408, and foot pads 414, constituting or included in driving mechanism 40, are operatively coupled to hubless flywheel 300, which in turn is rotatably coupled to rollers 200. This arrangement of driving mechanism 40 defines a closed path of motion for each of foot pads 414. Namely, each foot pad 414 is capable of moving along a closed path when it is actuated by a user of exercise machine 1. In this embodiment, the closed path thus defined is an elliptical path, or depending on a variation of the geometry of the links and joints of driving mechanism 40, approximates an elliptical path. During operation, as a user moves a foot pad 414 in an elliptical or near elliptical path continuously, an input of user is transmitted through swing link 410, side link 404, and relevant joints to hubless flywheel 300 to drive rotation of hubless flywheel 300, the rotation being facilitated by one or more of rollers 200.

As described, a user input can be transmitted to hubless flywheel 300 and/or rollers 200 through driving mechanism 40. Actuating foot pad 414 causes a force to be directly transmitted through the links and joints of driving mechanism 40 to hubless flywheel 300 and causes the rotation of hubless flywheel 300, and in turn the rotation of rollers 200. Also, because hubless flywheel 300 is weighted and rollers 200 are optionally weighted, a user input is transmitted by driving mechanism 40 and directly converted into rotational kinetic energy of hubless flywheel 300 including a moment of inertia absorbed and retained in hubless flywheel 300. In the embodiments shown in FIGS. 1 and 2, a user input can be efficiently transmitted to hubless flywheel 300 without a step-up mechanism.

Exercise machine 1 further includes a resistance device 150, as shown in FIG. 2. A resistance device 150 includes a conductive device 151, such as a conductive metal strip provided on an outer circumferential surface of hubless flywheel 300. Resistance device 150 also includes a plurality of magnets 152 provided close to the conductive metal strip and between rollers 200*a* and 200*b*. When hubless flywheel 300 rotates, a force opposing the rotation is generated as a result of an interaction between magnets 152 and the conductive metal strip. In other instances, an alternative or additional resistance device can be provided to oppose relative motions between the links of driving mechanism 40 or between driving mechanism 40 and frame 10. For example, a conductive device 151 can be provided on side link 404 close to rail 408 or base 100, and a magnetic device can be provided on or close to rail 408 or base 100. The conductive and magnetic devices are capable of interacting with each other and producing a resistance opposing relative motion between side link 404 and rail 408/base 100.

As shown in FIG. 6, a roller 200 optionally includes a protrusion 270 extending from a circumferential surface 260' and extending away from circumferential surface 260. Hubless flywheel 300 optionally includes a recess 320 in circumferential surface 310. As shown, protrusion 270 extends into recess 320. The extension of protrusion 270 into recess 320 may limit potential sideways movements of hubless flywheel 300 to achieve a stable engagement between hubless flywheel 300 and roller 200.

As shown in FIG. 6, a couple of reinforcing plates 280 are optionally provided on, by screwing, for example, radial surfaces of a roller 200 to provide additional strength to the roller. Reinforcing plates 280 can be made of steel, for example. Also shown in FIG. 6, a reinforcing plate 280 can be optionally configured to have a larger diameter than roller 200 such that a peripheral portion 282 of the plate "hangs" over a peripheral region of a radial surface of hubless flywheel 300. The peripheral portion of the plate may be capable of limiting potential sideways movements of hubless flywheel 300. In some instances, a roller 200 can be configured to include portions of a larger diameter to potentially limit a sideways movement of hubless flywheel 300.

Figure 3:
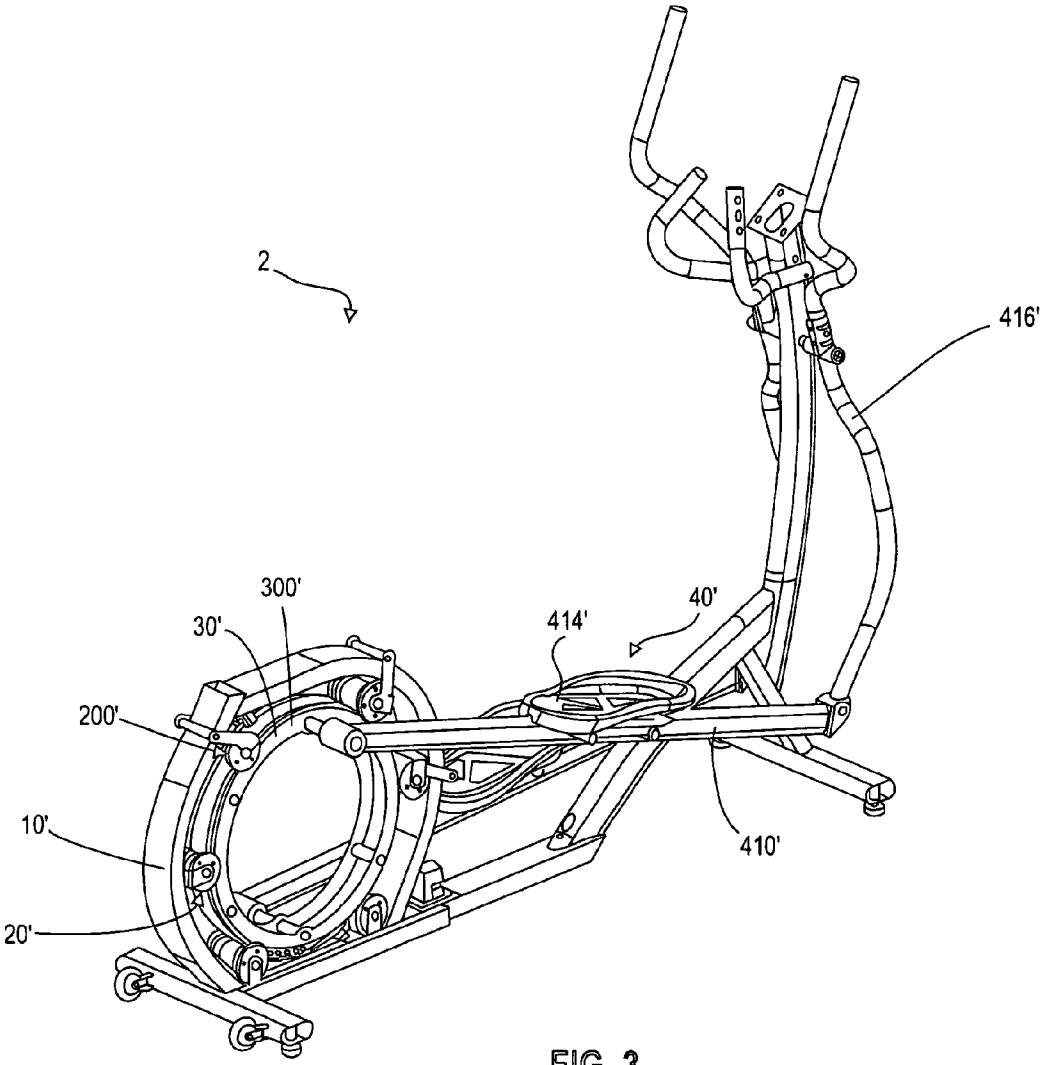
FIG. 3 is a perspective view showing an exercise machine according to another embodiment of the disclosure.

FIG. 3 shows a perspective view of an exercise machine 2 according to an embodiment of the disclosure. Exercise machine 2 is configured to incorporate many features that are the same or similar to the embodiments shown in FIGS. 1 and 2. Exercise machine 2 includes a frame 10', a first rotary mechanism 20', a second rotary mechanism 30', and a driving mechanism 40'. Frame 10' supports first rotary mechanism 20' and second rotary mechanism 30', which may be similarly configured as described above. However, the weight, size, and/or other specific properties of first rotary mechanism 20' and second rotary mechanism 30' of exercise machine 2 may differ from those of first rotary mechanism 20 and second rotary mechanism 30 of exercise machine 1. As shown in FIG. 3, first rotary mechanism 20' includes a plurality of rollers 200', and second rotary mechanism 30' includes a hubless flywheel 300'. Hubless flywheel 300' and rollers 200' are provided on frame 10' near a back end of exercise machine 2. In some instances, hubless flywheel 300' may be configured to have a different diameter, such as an outer diameter or an inner diameter, from that of hubless flywheel 300 of exercise machine 1. Driving mechanism 40' includes swing links 410' and arm links 416' and, through these links, is operatively coupled to hubless flywheel 300'. Foot pads 414' are attached to swing links 410' at positions in or near mid-sections of the links. Thus, driving mechanism 40' provides an elliptical or near elliptical motion for foot pads 414' and imparts rotation of hubless flywheel 300'. Similarly, driving mechanism 40' is configured to transmit a user input through the links and joints as depicted in FIG. 3 to allow hubless flywheel 300' and optionally rollers 200' to absorb and retain at least an amount of the user input as rotational inertia.

Figure 4:
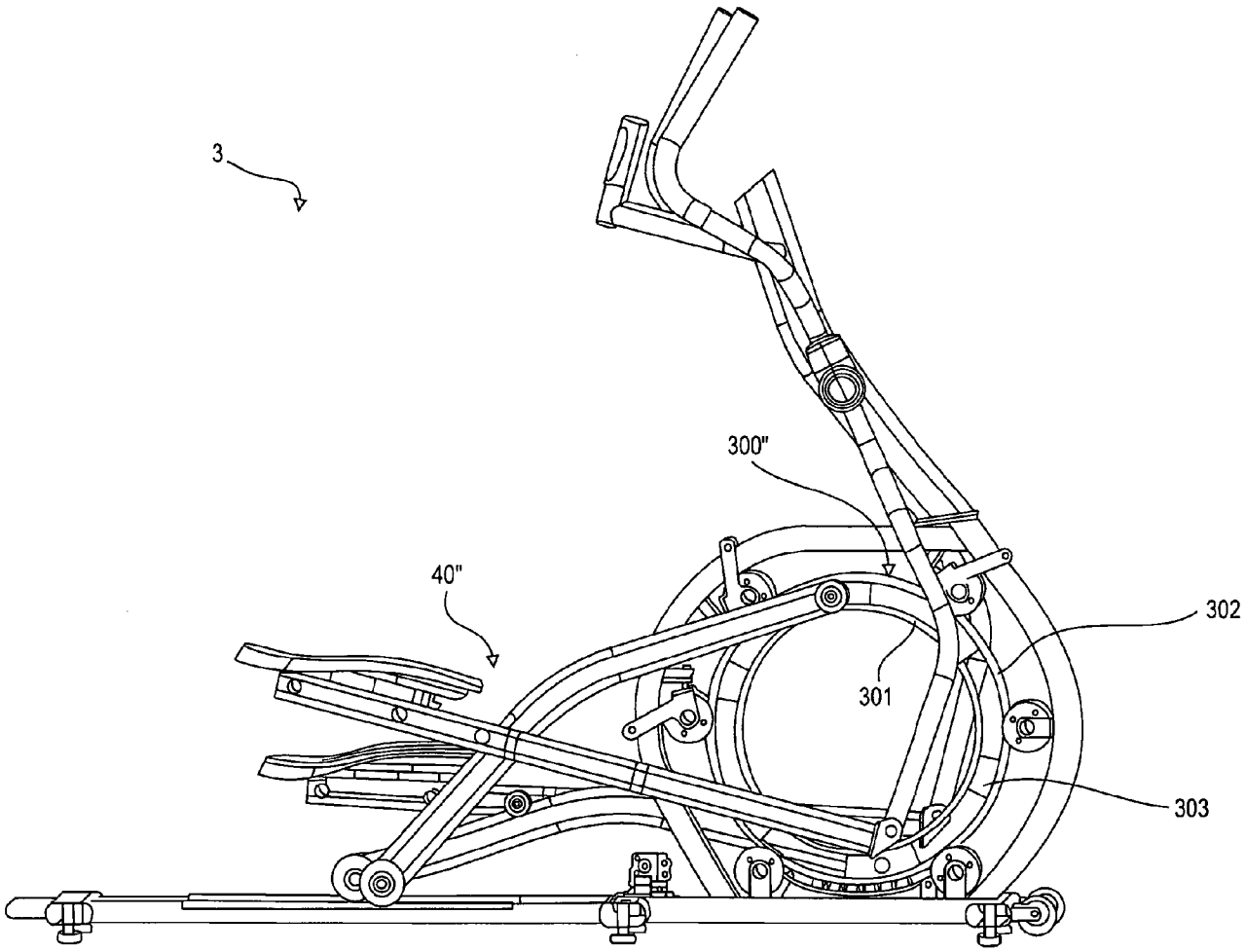
FIG. 4 is a side view showing an exercise machine according to yet another embodiment of the disclosure.

FIG. 4 shows a side view of an exercise machine 3 according to an embodiment of the disclosure. Exercise machine 3 is configured to include the same or similar features to exercise machine 1, except that for a hubless flywheel 300" is provided including an inner ring 301 and an outer ring 302, which are weighted rings concentrically arranged and joined together by a number of blocks 303. As shown here, driving mechanism 40" is operatively coupled to hubless flywheel 300" at two of blocks 303 that are 180 degrees apart on a circumference of hubless flywheel 300". In some instances, blocks 303 are weighted to increase the inertia of hubless flywheel 300". Also, additional blocks or weights can be provided between inner ring 301 and outer ring 302, or provided on an inner circumferential surface (facing inner ring 301) of outer ring 302. Similarly, driving mechanism 40" is configured to be capable of transmitting a user input through the links and joints as depicted in FIG. 4 to allow hubless flywheel 300" to absorb and retain at least an amount of the user input as rotational inertia.

Figure 5:
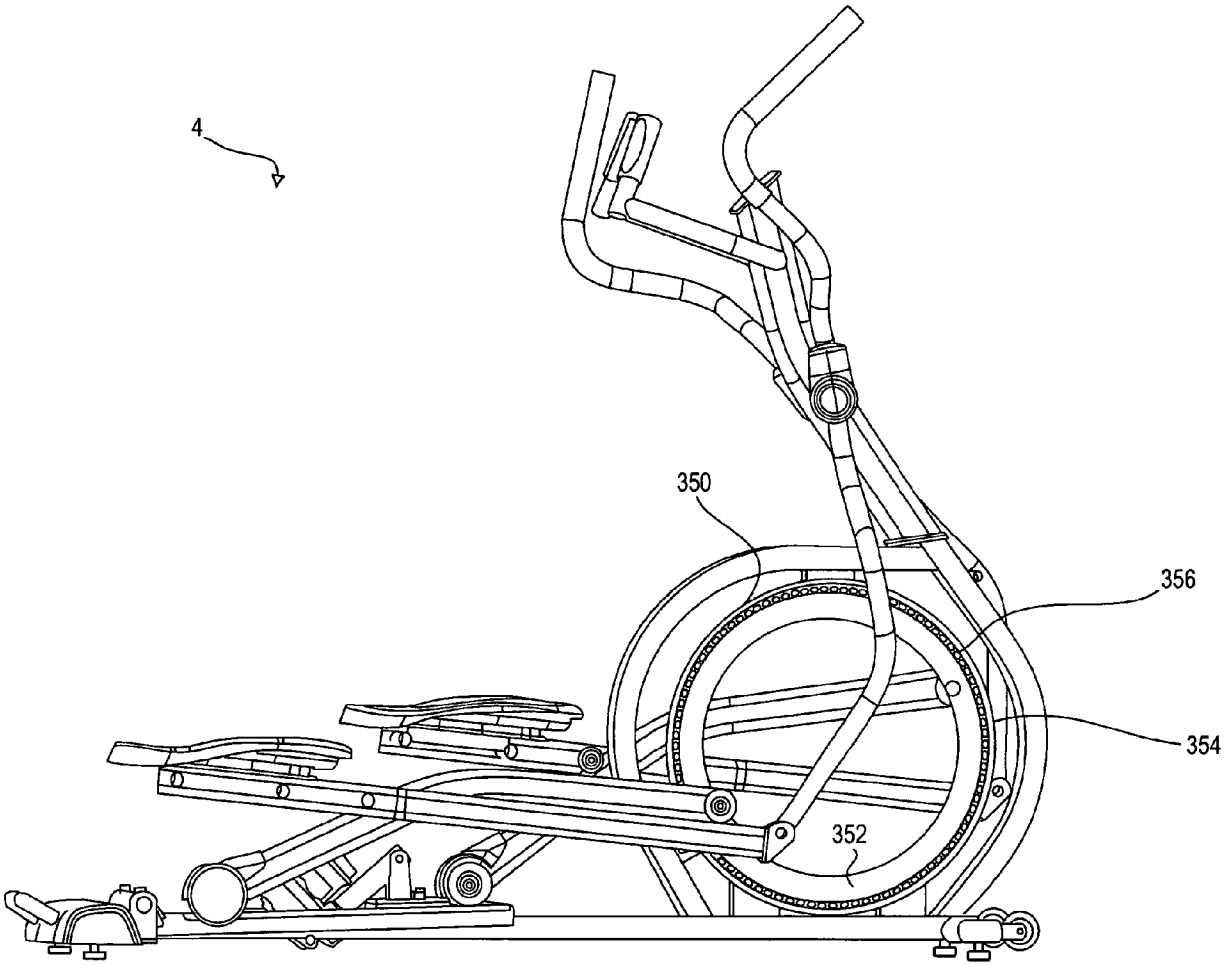
FIG. 5 is a perspective view showing an exercise machine according to yet another embodiment of the disclosure.

FIG. 5 shows a side view of an exercise machine 4 according to an embodiment of the disclosure. Exercise machine 4 is configured to include features similar to exercise machine 1 or 3 except that a hubless bearing 350 is provided instead of the specific first and second rotary mechanisms of exercise machines 1 and 3. Hubless bearing 350 includes an inner ring 352, an outer ring 354, and a plurality of balls 356 retained between inner ring 352 and outer ring 354. Outer ring 354 is fixed to a frame of exercise machine 4. Inner ring 352 is rotatably engaged with the plurality of balls 356 and is operatively coupled to a driving mechanism similarly to that of exercise machines 1 and 3. Similarly, the driving mechanism shown in FIG. 5 is configured to transmit a user input through links and joints to allow hubless bearing 350, or more specifically, inner ring 352 and optionally balls 356, to absorb and retain at least an amount of the user input as rotational inertia.

Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An exercise machine comprising:

a frame;

a first rotary mechanism supported on the frame;

a second rotary mechanism rotatably engaging with the first rotary mechanism, the second rotary mechanism being hubless; and a driving mechanism operatively coupled to the second rotary mechanism and being configured to impart rotation of the second rotary mechanism while the driving mechanism is being actuated, wherein the second rotary mechanism is configured to absorb and retain an amount of the actuation of the driving mechanism as a moment of inertia while the second rotary mechanism rotates, wherein the driving mechanism includes at least one link coupling to the second rotary mechanism, the driving mechanism being configured to move in an elliptical motion.

2. The exercise machine according to claim 1, wherein the second rotary mechanism is configured to absorb and retain an amount of the actuation of the driving mechanism as inertia while the second rotary mechanism rotates.

3. The exercise machine according to claim 1, wherein the first rotary mechanism is configured to absorb and retain an amount of the actuation of the driving mechanism via the second rotary mechanism as a moment of inertia while the first rotary mechanism rotates.

4. The exercise machine according to claim 1, the driving mechanism being configured to undergo a closed path motion having a rate of revolution the same as a rate of revolution of the second rotary mechanism.

5. The exercise machine according to claim 1, wherein the second rotary mechanism includes a first circumferential surface and a recess in the first circumferential surface and the first rotary mechanism includes a second circumferential surface and a protrusion extending from the second circumferential surface, the protrusion of the first rotary mechanism extending into the recess of the second rotary mechanism.

6. The exercise machine according to claim 1, wherein the second rotary mechanism includes a first circumferential surface and a protrusion extending from the first circumferential surface and the first rotary mechanism includes a second circumferential surface and a recess in the second circumferential surface, the protrusion of the second rotary mechanism extending into the recess of the first rotary mechanism.

7. The exercise machine according to claim 1, further comprising a resistance device including a conductive device provided on the second rotary mechanism and a magnetic device provided on the frame and being configured to interact with the conductive device to generate a resistance opposing a rotation of the second rotary mechanism.

8. The exercise machine according to claim 7, wherein the conductive device is provided on a circumferential surface of the second rotary mechanism.

9. The exercise machine according to claim 1, wherein the first rotary mechanism includes a plurality of rollers and the second rotary mechanism includes a hubless flywheel, the hubless flywheel being supported on at least two of the plurality of rollers.

10. The exercise machine according to claim 9, wherein the plurality of rollers rotatably engages with the hubless flywheel at a circumferential surface of the hubless flywheel.

11. The exercise machine according to claim 9, wherein the plurality of rollers surrounds the hubless flywheel and a circumferential surface of the hubless flywheel is configured to transmit rotation to the plurality of rollers.

12. The exercise machine according to claim 9, further comprising an adjuster for applying a pressure to at least one of the plurality of rollers to press the at least one of the plurality of rollers against the hubless flywheel, wherein a direction of the pressure applied offsets from a center of rotation of the at least one of the plurality of rollers.

13. The exercise machine according to claim 9, further comprising one or more weight blocks removably attached to the hubless flywheel.

* * * * *